US011044951B2

(12) United States Patent
Mercy

(10) Patent No.: US 11,044,951 B2
(45) Date of Patent: Jun. 29, 2021

(54) INFANT SLEEP BAG AND SWADDLING APPARATUS

(71) Applicant: GRO-GROUP INTERNATIONAL LIMITED, Newcastle upon Tyne (GB)

(72) Inventor: Debbie Mercy, Newcastle upon Tyne (GB)

(73) Assignee: Gro-Group International Limited, Newcastle Upon Tyne (GB)

( * ) Notice: Subject to any disclaimer, the term of this patent is extended or adjusted under 35 U.S.C. 154(b) by 85 days.

(21) Appl. No.: 16/318,841

(22) PCT Filed: Jul. 18, 2017

(86) PCT No.: PCT/EP2017/068082
§ 371 (c)(1),
(2) Date: Jan. 18, 2019

(87) PCT Pub. No.: WO2018/015362
PCT Pub. Date: Jan. 25, 2018

(65) Prior Publication Data

US 2019/0239573 A1 Aug. 8, 2019

(30) Foreign Application Priority Data

Jul. 19, 2016 (GB) ..... 1612489
Jan. 16, 2017 (GB) ..... 1700698

(51) Int. Cl.
*A41B 13/06* (2006.01)
*A47G 9/08* (2006.01)
*A47G 9/06* (2006.01)

(52) U.S. Cl.
CPC ..... *A41B 13/065* (2013.01); *A41B 13/06* (2013.01); *A47G 9/068* (2013.01); *A47G 9/083* (2013.01);
(Continued)

(58) Field of Classification Search
CPC ..... A41B 13/06; A41B 13/00; A41B 13/065; A41B 2300/324; A41B 2300/33;
(Continued)

(56) References Cited

U.S. PATENT DOCUMENTS 782,819 A * 2/1905 Bikie ..... A47G 9/08 2/75
2,530,464 A 11/1950 Haman
(Continued)

FOREIGN PATENT DOCUMENTS

AU 2008201742 11/2008
AU 2011100230 11/2014
(Continued)

OTHER PUBLICATIONS

PCT International Search Report and Written Opinion issued in International Application No. PCT/EP2017/068,082, dated Nov. 23, 2017, 12 pages.

*Primary Examiner* — Amy Vanatta
(74) *Attorney, Agent, or Firm* — Fish & Richardson P.C.

(57) ABSTRACT

An infant sleep bag, comprising a main body including multiple fixing points and arm or wing portions arranged on either side of the main body, wherein respective arm or wing portions include fixing means to engage with respective ones of the multiple fixing points, whereby to enable the arm or wing portions of the bag to be placed into selected ones of multiple configurations.

8 Claims, 19 Drawing Sheets

(52) U.S. Cl.
CPC ..... *A41B 2300/324* (2013.01); *A41B 2300/33* (2013.01)

(58) Field of Classification Search
CPC ..... A41B 13/08; A47G 9/083; A47G 9/068; A47G 9/08; A41D 11/00; A41D 10/00; A41D 13/1272; A41D 13/1245; A41D 13/1236; A41D 13/1263; A41D 13/129
USPC ..... 2/111, 69.5
See application file for complete search history.

(56) References Cited

U.S. PATENT DOCUMENTS

| | | | | |
|---|---|---|---|---|
| 4,688,282 | A * | 8/1987 | Jeffries | A47D 15/008 2/69.5 |
| 5,535,449 | A * | 7/1996 | Dickey | A41B 13/06 2/69 |
| D669,659 | S | 10/2012 | Barski | |
| 8,302,225 | B1 * | 11/2012 | Earnest | A47G 9/083 5/413 R |
| D728,199 | S | 5/2015 | Barski | |
| 9,516,902 | B1 * | 12/2016 | Adani | A41B 13/06 |
| 9,999,265 | B2 * | 6/2018 | Monardo | A41D 13/1236 |
| 10,278,514 | B1 * | 5/2019 | Emerson | A47D 13/02 |
| 2006/0010600 | A1 * | 1/2006 | Kendy | A47D 15/005 5/482 |
| 2006/0236441 | A1 | 10/2006 | Johnson et al. | |
| 2009/0064390 | A1 | 3/2009 | Beiring et al. | |
| 2011/0088136 | A1 * | 4/2011 | Isler | A41B 13/06 2/83 |
| 2011/0179546 | A1 | 7/2011 | Millette et al. | |
| 2011/0180079 | A1 * | 7/2011 | Krawchuk | A61F 5/37 128/873 |
| 2013/0139290 | A1 | 6/2013 | Barski | |
| 2014/0033430 | A1 * | 2/2014 | Daugherty | A41B 13/06 5/494 |
| 2016/0021936 | A1 | 1/2016 | Delano | |
| 2016/0113331 | A1 | 4/2016 | Blacker | |
| 2019/0191785 | A1 * | 6/2019 | Vincent | A41B 13/06 |

FOREIGN PATENT DOCUMENTS

| | | | | |
|---|---|---|---|---|
| CN | 203953125 | | 11/2014 | |
| DE | 102015014578 | A1 * | 5/2017 | A47G 9/083 |
| DE | 102016212895 | A1 * | 1/2018 | A47G 9/083 |
| DE | 202019100221 | U1 * | 2/2019 | A47G 9/083 |
| FR | 3022742 | | 1/2016 | |
| GB | 488226 | A * | 7/1938 | A41B 13/06 |
| WO | 02/00048 | | 1/2002 | |
| WO | WO2016021936 | | 2/2016 | |
| WO | WO2016038101 | | 3/2016 | |
| WO | WO-2019152899 | A1 * | 8/2019 | A41B 13/06 |

* cited by examiner

INFANT SLEEP BAG AND SWADDLING APPARATUS

CROSS REFERENCE TO RELATED APPLICATION

This application is a 371 National Stage of International Application No. PCT/EP2017/068082, filed Jul. 18, 2017, incorporated herein by reference in its entirety. This application claims priority to GB 1612489.3 filed Jul. 19, 2016 and GB 1700698.2 filed Jan. 16, 2017.

TECHNICAL FIELD

The present invention relates, in general, to an infant sleep apparatus, and more particularly, although not exclusively to infant sleep bags and swaddles.

BACKGROUND

Baby sleep or sleeping bags, and more generally infant and child sleeping bags, are a convenient and safe alternative to traditional blankets, and are typically recognised as safer alternatives compared to more traditional bedding as they prevent an infant's head from getting covered by bedding. In addition, they prevent the infant from kicking off bedding and waking up because they are cold for example.

Swaddling can be used to wrap an infant for warmth and security, and can prevent an infant baby from being disturbed by their own startle reflex. However, if an infant is swaddled too tightly there is a risk of overheating and/or a risk of hip dysplasia for example. Furthermore, one swaddling position may not be suitable for all infants. The ability to be able to modify the swaddle position of an infant can be advantageous in order to accommodate different infant needs and sizes.

SUMMARY

According to an example, there is provided an infant sleep bag, comprising a main body including multiple fixing points and arm or wing portions arranged on either side of the main body, wherein respective arm or wing portions include fixing means to engage with respective ones of the multiple fixing points, whereby to enable the arm or wing portions of the bag to be placed into selected ones of multiple configurations. Each arm or wing portion may comprise multiple fixing means. The fixing portions and fixing means may be in the form of poppers (male snap fastener/female snap fastener), hook and loop fastening and so on. Respective ones of the multiple fixing means can be arranged in spaced relation to one another on an arm or wing portion. At least some of the multiple fixing means can be arranged around the periphery of an arm or wing portion. For example, the fixing means may be arranged around the edges of the arm or wing portions and spaced from one another to enable multiple different swaddling configurations to be selected. Individual ones of the multiple fixing means can be configured to engage with one of the multiple fixing points on the main body of the bag. For example, male/female popper portions on the main body can engage with corresponding female/male popper portions on the arm or wing portions. Each of the multiple fixing means is configured to engage with respective different ones of the multiple fixing points on the main body of the bag.

In an example, the arm or wing portions are in the form of a bolero or shrug which can be attached to or integral with the portions of the rear of the main body of the bag. The arm or wing portions can be attached to or integral with the rear of the main body of the bag along a lateral line of attachment widthways across the back of the main body. Respective ones of the arms may be positioned differently from one another. That is, each arm or wing portion may be placed into a different configuration to form an asymmetrical swaddling configuration. Respective arm or wing portions can comprise a pocket configured to receive the arms or a portion of the arms of an infant. An infant's arm placed into an arm or wing portion can be maintained in an elbows bent hands raised position when the arm or wing portions are not attached to the main body for example. The arm or wing portions can include an arm opening to receive the arms of an infant, and a further opening for the infant's hands to pass out of.

The fixing points can be positioned in a central region of the front of the main body of the bag. They may be attached to the bag by way of a secondary piece of material to provide reinforcement and/or cushioning for example. The arm or wing portions can include hand openings. A hand opening can include a closure mechanism, whereby to enable the cuff of the hand opening to be reduced in size. An opening can be provided between respective arm or wing portions and the main body of the bag. This can enable warm air to vent from the bag. A front and/or rear opening configured to receive at least a portion of a harness or strap for securing an infant can be provided. One or more visual indicators arranged on, around or in the proximity of the fixing points can be provided, whereby to indicate swaddling configurations for a user.

According to an example, there is provided a swaddling apparatus comprising a main body portion comprising multiple fixing points configured to enable one of multiple swaddling positions to be selected, and arm or wing portions arranged on either side of the main body, wherein respective arm or wing portions include fixing means configured to engage with respective ones of the multiple fixing points. The arm or wing portions can be in the form of a bolero or shrug which is attached to or integral with the rear of the main body at least one portion of the rear of the main body. The arm or wing portions can be attached to or integral with the rear of the main body of the bag at a lateral line of attachment across the back of the main body. A visual indicator on, around or in the proximity of one or more of the multiple fixing points can be provided, whereby to provide a mapping relating a fixing point to a swaddling configuration.

The arm or wing portions can comprise respective flaps including respective overlapping portions. The multiple fixing points can be arranged symmetrically and centrally on the main body portion of the bag. The arm or wing portions can comprise an overlapping portion configured to receive and/or support the elbows of an infant.

BRIEF DESCRIPTION OF THE DRAWINGS

Embodiments will now be described, by way of example only, with reference to the accompanying drawings, in which.

DESCRIPTION

Figure 1:
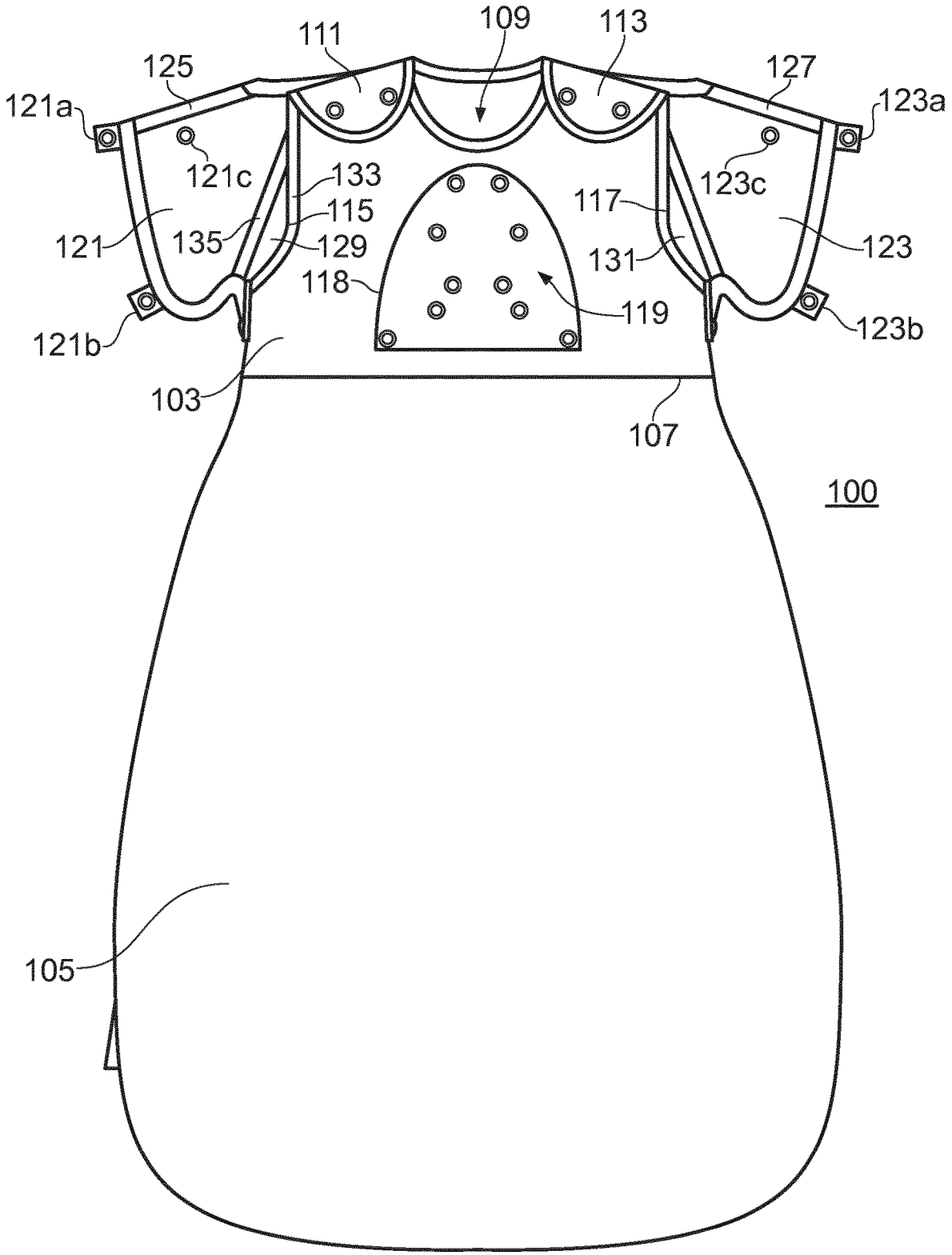
FIG. 1 is a schematic representation of an infant sleep or sleeping bag or apparatus according to an example.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

FIG. 1 is a schematic representation of an infant sleep or sleeping bag or apparatus, such as a swaddling apparatus, according to an example. The bag 100 comprises an upper region, depicted generally as 103 and a lower region, depicted generally as 105. The upper and lower regions are separated from another, in an example, by a seam 107. The material used for the upper and lower regions may be the same or different. The thermal rating of the upper and lower regions may be the same or different. For example, the lower region may have a higher thermal rating (e.g. tog value) than the upper region, which itself may be made from a material with an elastic component to promote a swaddling function. Materials with an antibacterial, antimicrobial or insecticidal function or property may be used in either or both regions.

Lower region 105, as depicted in FIG. 1 for example, can be flared. That is, the lower region can widen away from the upper region in order to provide room for unhindered leg movement, which can be beneficial to reduce the risk of hip dysplasia in infants. A closure mechanism (not shown) can be provided around at least a portion of the lower region to enable the lower region to be opened to allow a nappy, for instance, to be changed without having to completely remove an infant from the bag 100.

On either side of a neck opening 109, flap portions 111, 113 can be provided, which may be independently opened or closed using, for example, poppers, whereby to enable the bag 100 to be fully opened so that an infant may be introduced or removed therefrom. The arms of an infant in the bag 100 pass through arm hole openings 115, 117 in the main body of the bag 100. In an example, the main body can receive the torso and legs of an infant, and may therefore include the upper and lower regions of the bag. The main body includes multiple fixing points 119. In the example of FIG. 1, the fixing points are arranged on the upper region 103 of the bag 100 (front bodice portion), below the neck opening 109 and above the seam 107.

The fixing points can be provided on an area 118 of reinforcement in the form of an additional area of material for example as will be described in more detail below with reference to FIG. 2.

Arm portions 121, 123 are arranged on either side of the main body and are configured to receive the arms of an infant. Respective arm portions 121, 123 include fixing means adapted to engage with respective ones of the multiple fixing points 119, whereby to enable the arm portions of the bag to be placed into selected ones of multiple configurations as will be described below in more detail.

Openings 125, 127 on the arm portions 121, 123 are provided for an infant's hands to pass through. That is, the arms of an infant in bag 100 pass through openings 115, 117, are introduced in the arm portions 121, 123 and the hands pass out through openings 125, 127 such that the arms are held (as shown in the configuration of FIG. 1) in place in the arm portions 121, 123 in an 'elbow bent' configuration with the hands located outside of the arm 10 portions whereby to enable an infant to access the hands directly for non-nutritive sucking for example, which is known to have a beneficial and soothing effect. Advantageously, because the hands are free of the bag and arm portions, non-nutritive sucking and so on does not result in soggy material that would otherwise be the case if the hands were inside the arm portions (or bag).

In the example of FIG. 1, the fixing means are in the form of popper portions 121*a-c*, 123*a-c* (male or female) that can engage with corresponding (female or male) popper portions 119. There is a symmetry to the distribution of fixing points 119 (about the vertical through the centre of the bag 100 in the example of FIG. 1), which enables the arm portions 121, 123 to be arranged or fixed in the same way, if desired. Alternatively, arm portions 121, 123 may be arranged in different positions relative to one another simply by using a different set of fixings on either one or both of the arm portions and main body.

Figure 2:
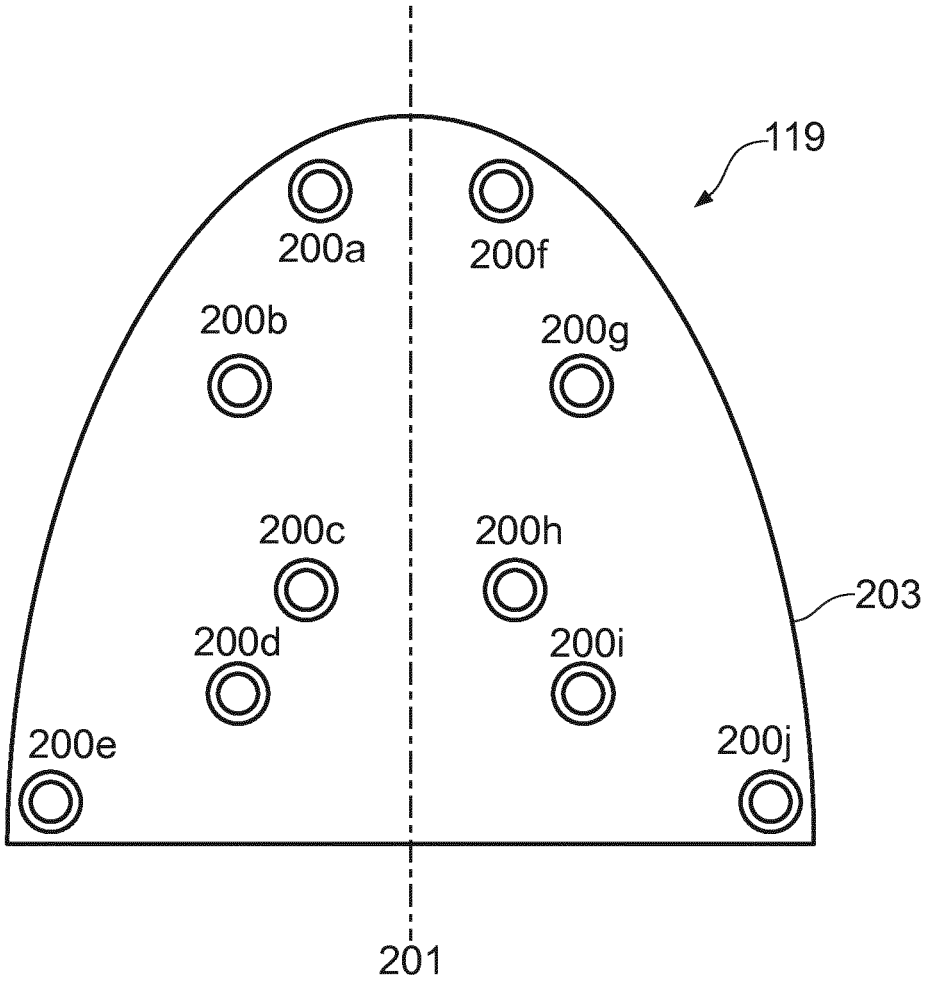
FIG. 2 is a schematic representation of multiple fixing points according to an example.

FIG. 2 is a schematic representation of multiple fixing points according to an example. In the example of FIG. 2 the fixing points 119 are in the same configuration as those of FIG. 1, and are symmetrical about a vertical line 201. The fixing points 200*a-j* can be provided on a portion or area of material 203 of any desired shape and which can be fixed to the bag 100 by sewing for example. The shape may be chosen to complement the arrangement of the fixing points, or may be a more fanciful design suitable for an infant sleeping bag. The portion 203 can provide reinforcement for the fixing points 200*a-j*, which may be popper portions, as noted above. For example, the fixing means may be securely attached to the portion 203 which can then be fixed to the bag 100. In this way, any part of the fixing portions that may protrude from the rear of the portion 203 will be cushioned by the outer layer of material of the bag 100 when the portion 203 is secured thereto. This will prevent any protruding portion coming into contact with an infant in the bag, and also serve to cushion an infant from any injury or discomfort as a result of the fixing portions being engaged with corresponding portions on the arms of the bag.

The portion or area 203 (118) can include an indication such as a visual indication as to how the various fixing points may be used in relation to the configuration that they place an infant's arms into. For example, a colour coding may be provided on, around or in the proximity of some or each of the fixing points which can be used to map to specific swaddling configurations based on the way those fixing points are attached to the corresponding fixing portions on the arms. The colour coding can be replaced by or augmented with textual information for a user to indicate the nature of the swaddling configurations.

Figure 3:
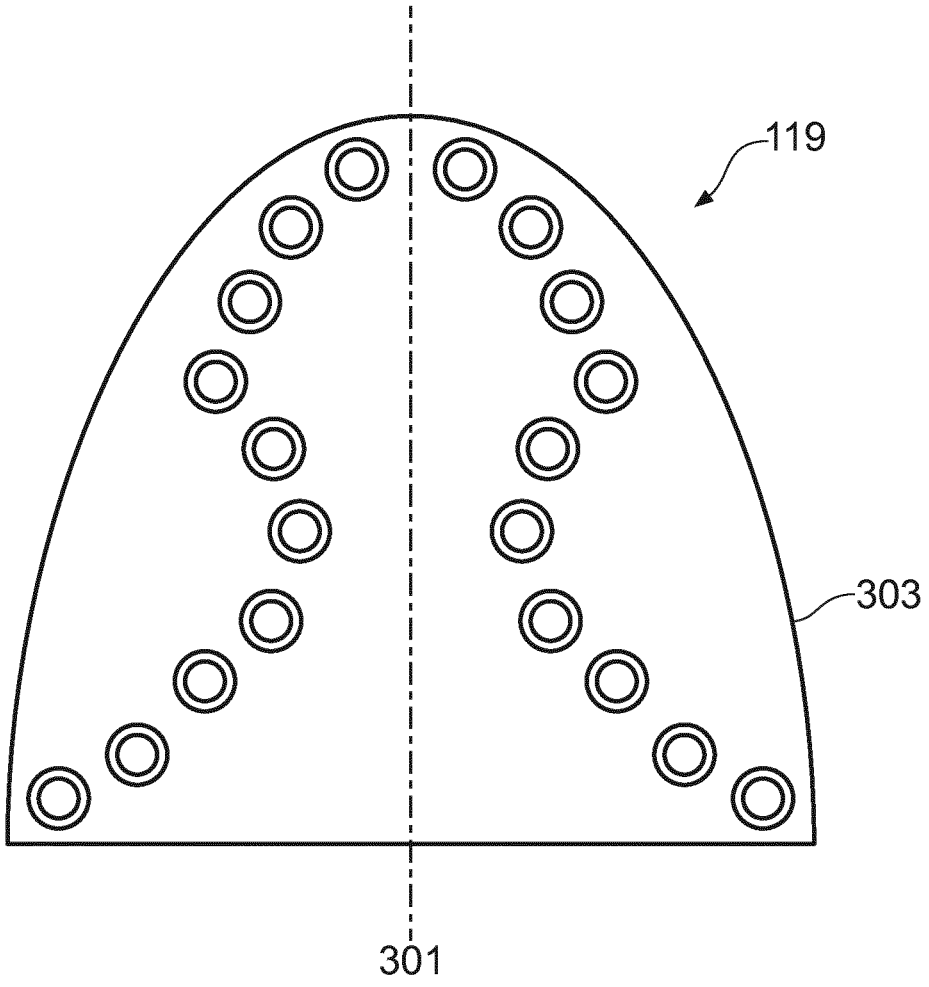
FIG. 3 is a schematic representation of multiple fixing points according to an example.

FIG. 3 is a schematic representation of multiple fixing points according to an example. In the example of FIG. 3 the fixing points 119 are in a different configuration as those of FIGS. 1 and 2. The fixing points 119 are symmetrical about a vertical line 301 and may be provided on a portion of material 303, similarly to that described with reference to FIG. 2. Broadly speaking, the configurations shown in FIGS. 2 and 3 provide the opportunity for multiple swaddling positions to be selected by a user. The non-linear arrangement of the fixing points enables suitable swaddling position to be selected, as will be described below in more detail.

With reference to FIG. 2, by engaging a corresponding popper portion on an arm portion of the bag 100 to one of the portions 200*a-j*, the arm portion can be releasably fixed in place, whereby to provide a swaddling function. This is similarly the case with the arrangement shown in FIG. 3. Accordingly, multiple interchangeable arm positions can be provided, thereby enabling the upper body of an infant to be safely swaddled whilst ensuring that the infant is wrapped below the neck to avoid covering the face.

In an example, an underarm ventilation portion for each arm 129, 131 can be provided. This can, as in the example shown in FIG. 1, default to being always open, or alternatively can be closable. For example, poppers provided on the side seams 133, 135 can be configured to enable the opening 129 to be closed. Similar considerations apply to opening 131. Thus, one or both arms can be opened up to allow an infant to cool down. The lack of fabric in the ventilation portions also means that in each arm position fabric will not gather up under an infant's arms, therefore preventing this area from getting too hot.

Figure 4:
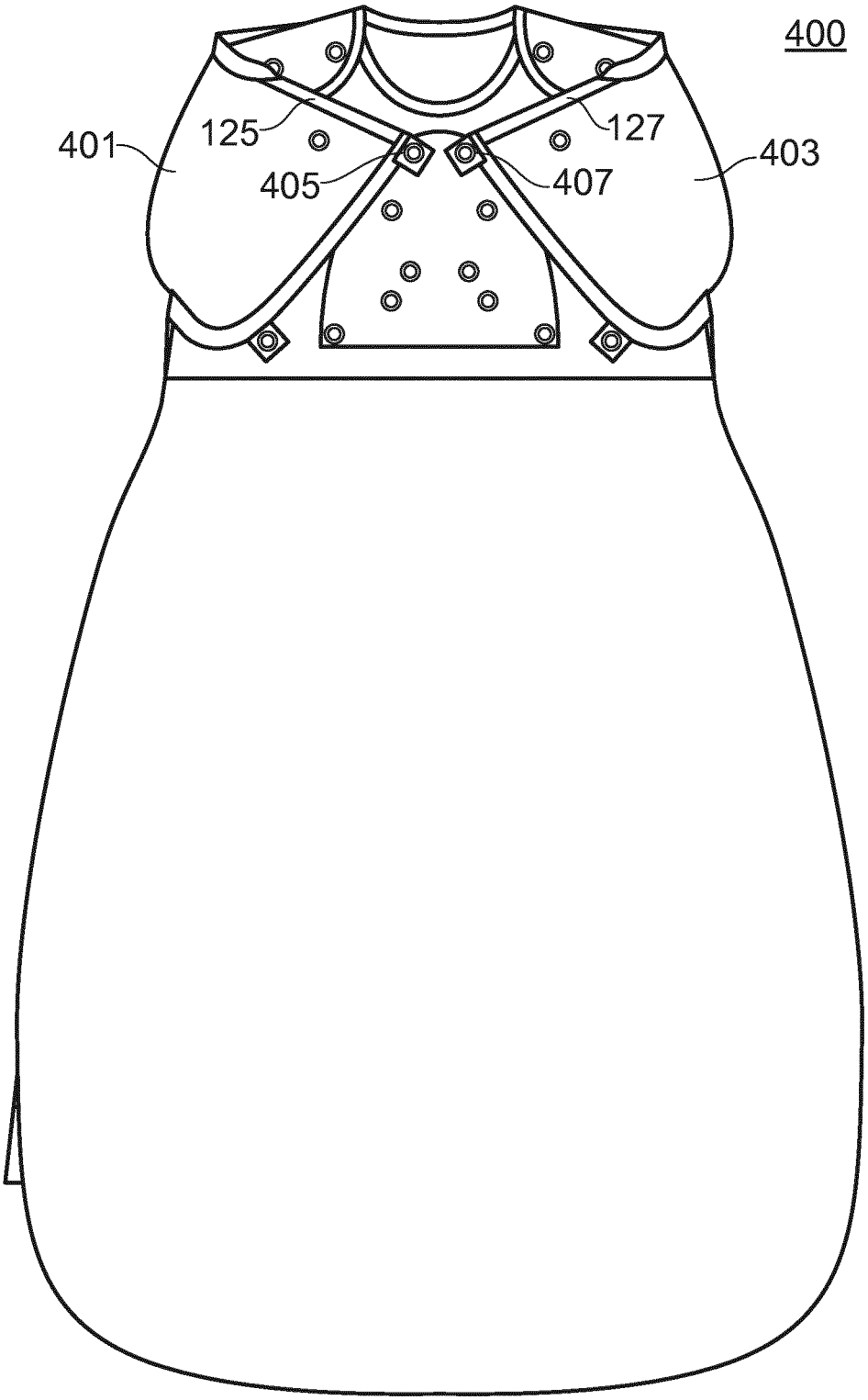
FIG. 4 is a schematic representation of an infant sleep bag according to an example.

FIG. 4 is a schematic representation of an infant sleep bag according to an example. In the example of FIG. 4, the arm portions 401, 403 are attached in a first configuration representing a 'hands-to-chin' swaddling position. Fixing means 405, 407, which in the example of FIG. 4 are popper portions, engage with corresponding popper portions on the front bodice of the bag 400 (which are obscured from view in this example, but which may be portions 200*a* and 200*f* shown in FIG. 2, or correspondingly positioned portions on the arrangement shown in FIG. 3). Hand openings 125, 127 are shown, and their position relative to the region in which an infant's head would be is such as to enable non-nutritive sucking.

It is typically accepted that tight chest swaddling/wrapping is linked with an increased risk of pneumonia. However, the present bag freely allows for chest wall expansion as no wrapping is done.

All of the arm positions also allow for elbow flexion, and snugly swaddle the tummy. There is typically no need to discontinue use when an infant can roll (usually around 4-6 months old). Rather, the bag can be used in a "transitional" position, such as shown in FIG. 1 for example. Once the startle reflex has disappeared (usually around 3 months), an infant can wear the bag in the open-arm or transitional position. An infant who resists standard swaddling positions can also wear the product in these two positions.

Hands can also be positioned in a "down" or "to-tummy" position to keep hands from impairing latch-on when establishing breastfeeding. The hands can then be positioned in all other positions once latch-on is established and baby is feeding well. A benefit of baby's hands being uncovered in these positions means mother and baby can benefit from being skin to skin.

Thus, a variety of swaddling techniques/positions appropriate to the baby's developmental age can be used based on the principals of safe swaddling. For example, younger infants less than 3 months old may have their arms included in the wrap to reduce the effect of the startle reflex, whilst an older baby over 3 months may have their lower body wrapped and their hands free allowing them access to their hands and fingers to promote self-soothing behaviour. This also reduces the risk of the baby turning onto its tummy.

Figure 5:
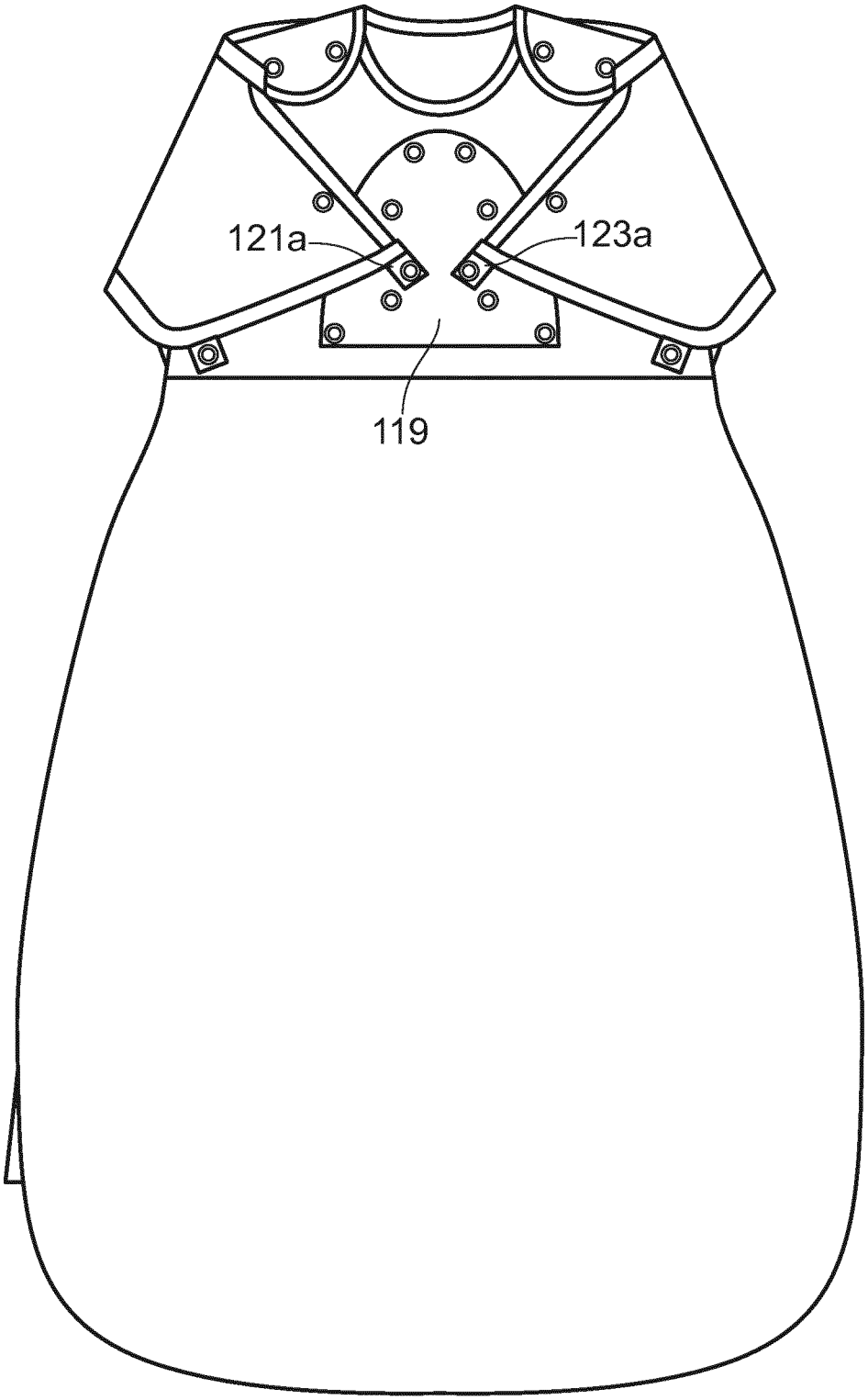
FIG. 5-9 are schematic representations of an infant sleep bag according to an example.
Figure 6:
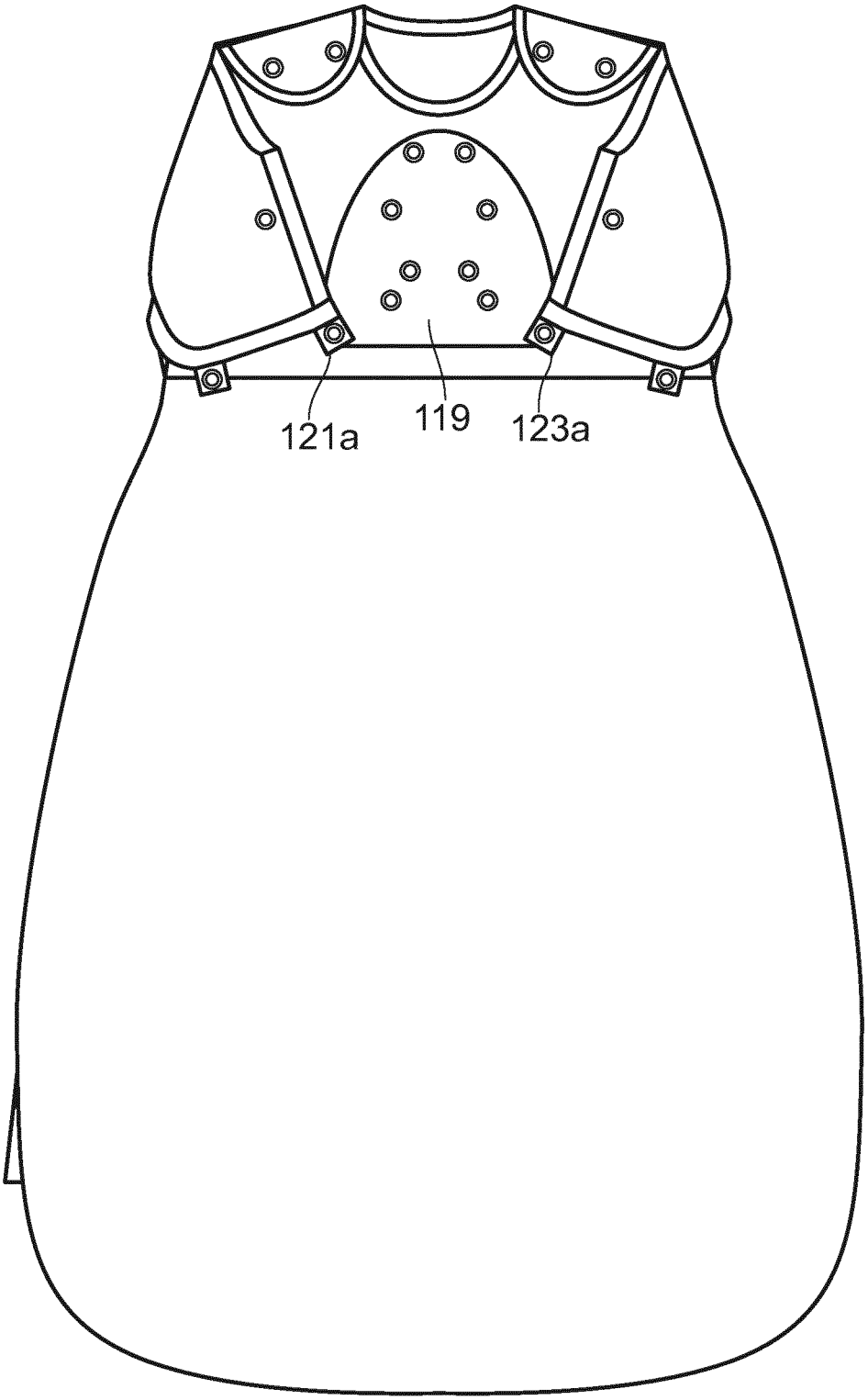
Figure 7:
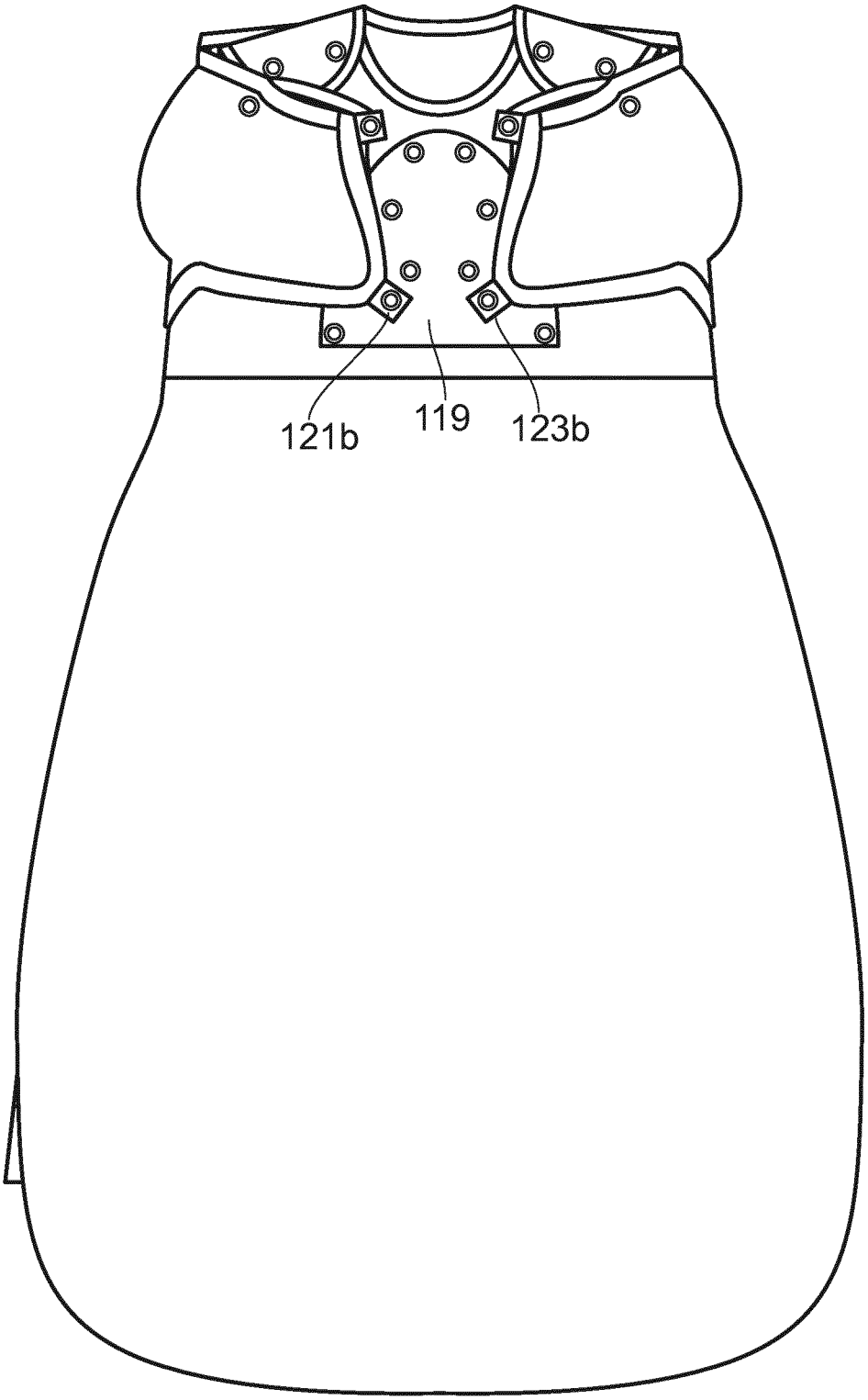
Figure 8:
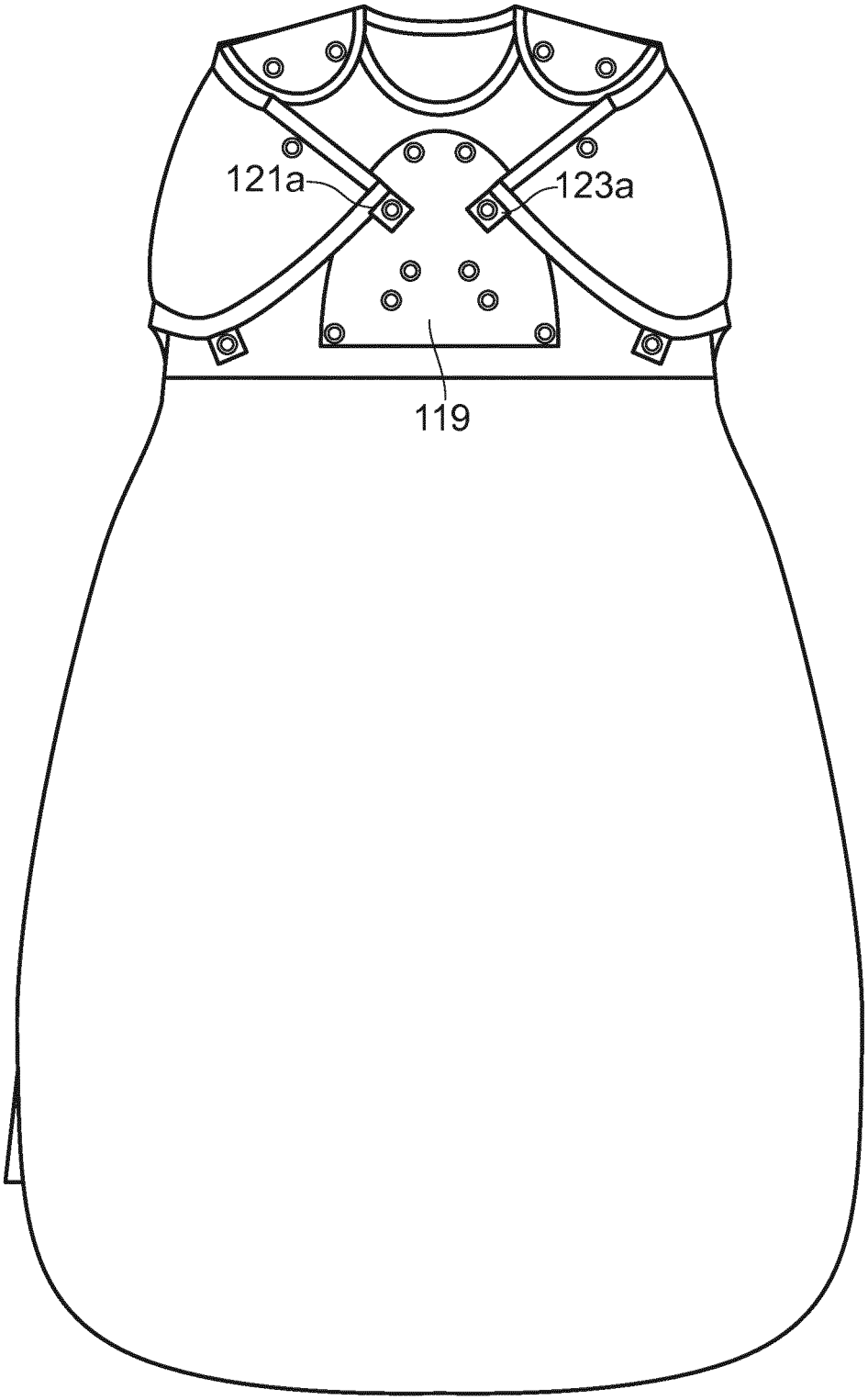
Figure 9:
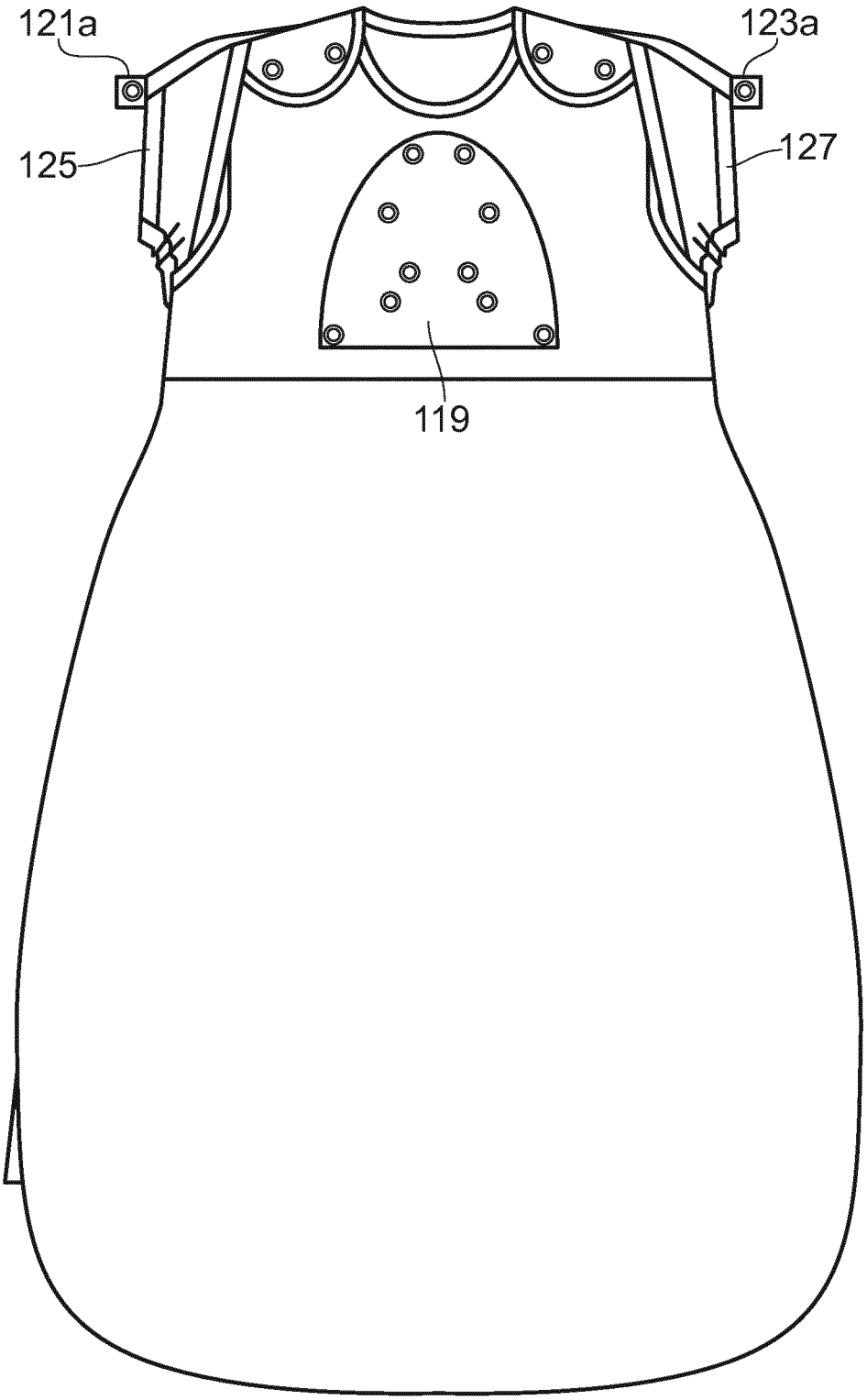

FIG. 5-9 are schematic representations of an infant sleep bag according to an example. Each of the examples shown in FIGS. 5-9 represents a different swaddling configuration in which the arm portions are engaged with the fixings on the bodice of the bag at different positions. FIG. 5, for example, provides an "arms down" swaddling position. FIG. 6 provides a "hands-to-tummy" swaddling position. FIG. 7 provides a "hands-to-face/cheek" swaddling position. FIG. 8 provides a "hands-to-heart" swaddling position. FIG. 9 shows a transitional configuration, in which the arms of an infant are placed fully through the wrist openings in the arm portions to provide a "short sleeved" configuration. FIG. 1 shows an alternative transitional position in which there is no swaddling.

As can be seen with reference to FIGS. 5-9, taking into account the provision of multiple 5 fixing means 121 *a-c*, 123*a-c* on the arms portions 121, 123, a large number of swaddling and other (such as transitional) positions is provided for. As noted above, each of the arm portions may be in a different configuration. That is, it is not necessary for both arm portions to be fixed in the same way, and different swaddling configurations can be used on different arms.

According to an example, the arm portions 121, 123 can be attached to the main body of a bag (composed of the upper and lower regions as described above) in the form of a bolero. That is, the arm portions can be provided as part of an upper structure that can be connected or attached to a bag. This may be in the form a permanent attachment (such as performed at time of manufacture for example), or removable attachment that may be performed by an end user so as to enable a bag to be converted into a swaddle apparatus as described herein.

The bolero portion or upper structure may be stitched to the rear of the upper region of the main body along the back of the neck area and along the back of the bag in line with seam 107 for example. In this way, a degree of stretch/movement can be provided so that it is easier to pass the arms of an infant through the portions and out of the wrist holes, and also so that there is some degree of flexibility in the arm portions to enable the different swaddling configurations to be used without causing any constriction of the infant.

Figure 10:
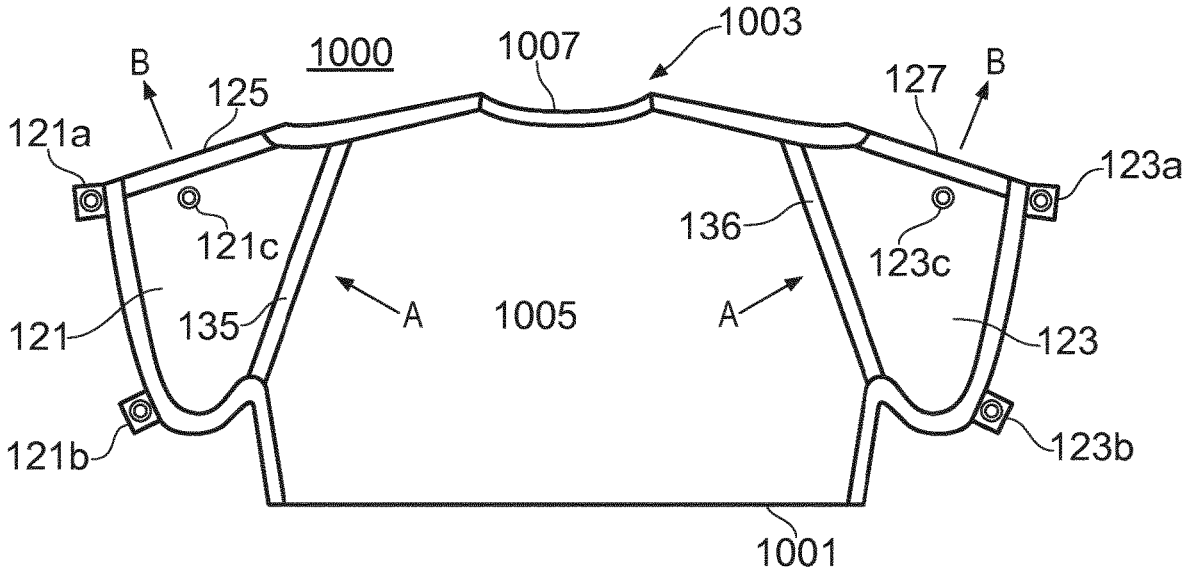
FIGS. 10 and 11 are front and rear schematic representations of an upper structure according to an example.
Figure 11:
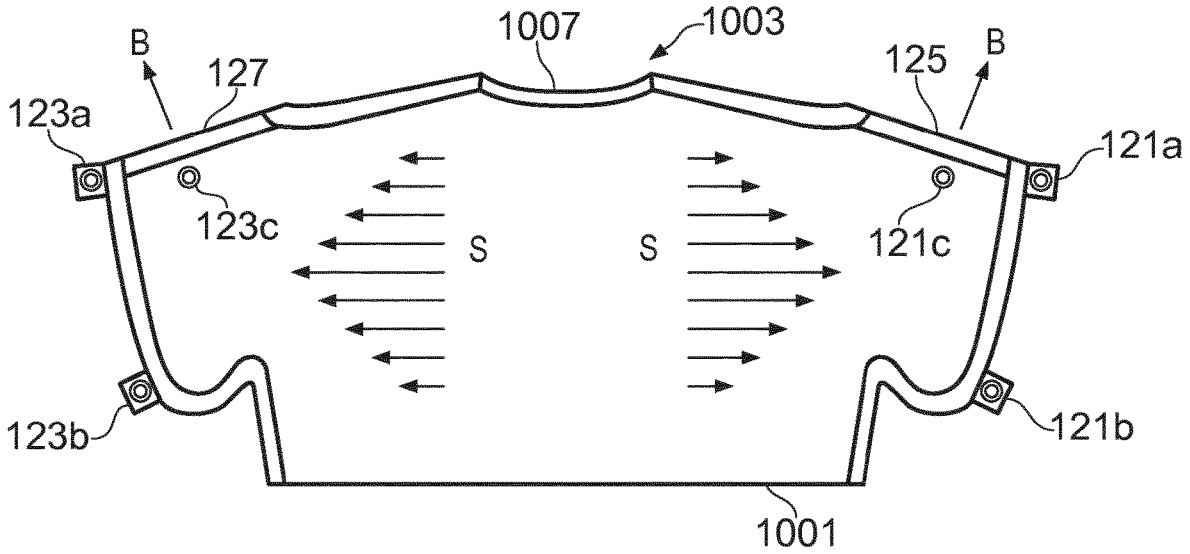

FIGS. 10 and 11 are front and rear schematic representations of an upper structure according to an example. More particularly, FIG. 10 shows the upper structure (or bolero portion) 1000 from the front. In the example of FIG. 10 the fixing means 119 are omitted for clarity. Portions 121, 123 are in the form of sleeves arms are inserted in direction A under seams 135, 136 through the sleeves, and then the hands pass in direction B from the openings 125, 127. FIG. 11 shows the portion of FIG. 10 from the rear.

In an example, the upper structure as shown in FIGS. 10 and 11 is attached or otherwise connected to an infant sleep bag in order to provide the apparatus as depicted in FIGS. 1-9. FIGS. 10 and 11 depict certain aspects of the apparatus in more detail. The attachment may occur across the bottom 1001 and top 1003 of the structure, or may be localised across portions of these, such as using only the curved neck region 1007 for example. As such, the upper structure and the bag define a channel between the front 1005 of the structure 1000 and the rear of the upper region of the bag. This enables a degree of stretch for the structure, as it is only connected to the bag laterally. Accordingly, as shown in FIG. 11 for example, the upper structure, when attached to a bag, can be stretched in the directions S by, very broadly, the magnitude shown by the length of the arrows. That is, as the edges 1001, 1003 where the structure 1000 is attached to the bag are approached, the degree of movement reduces compared to the latitude of movement provided at the centre.

Figure 12:
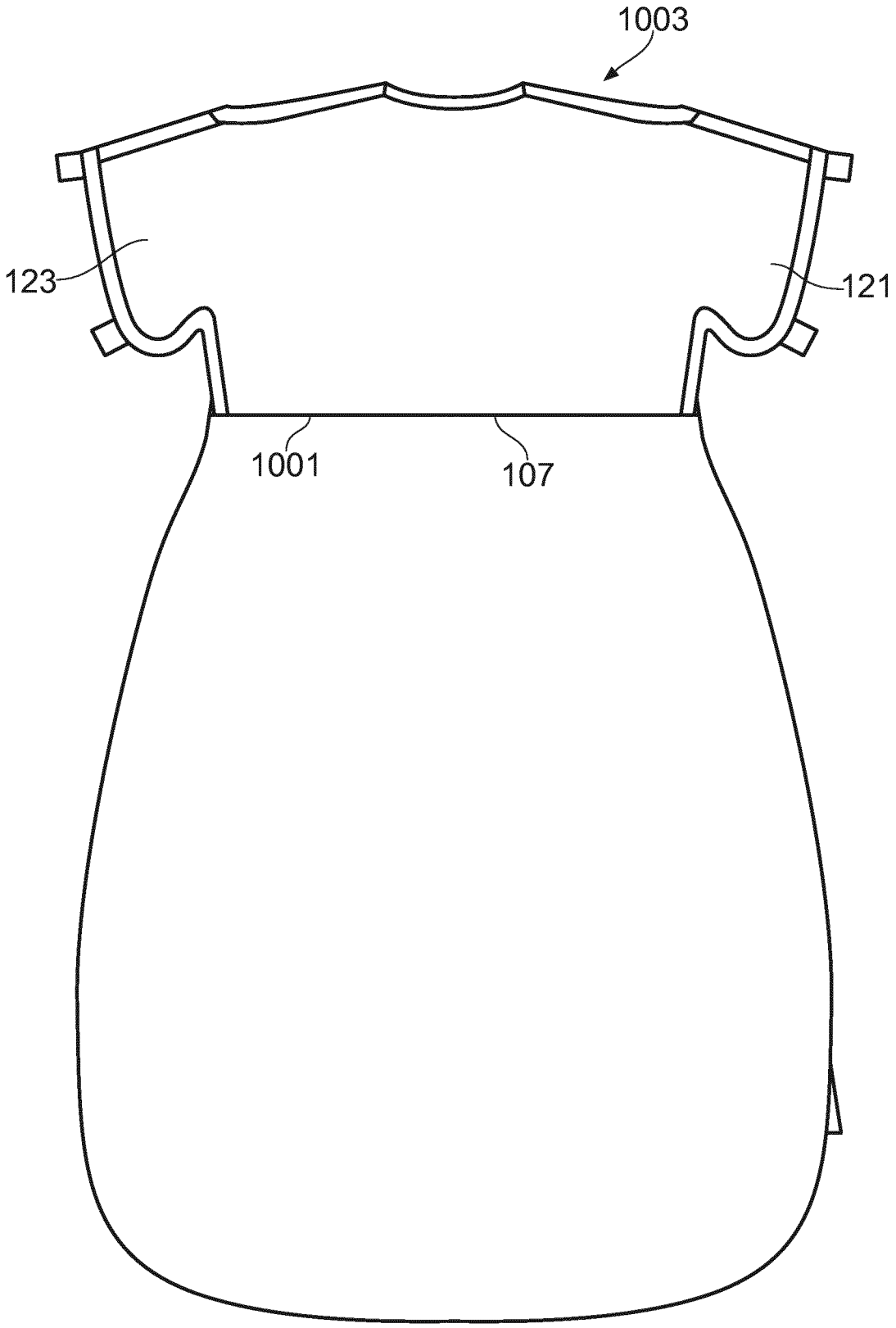
FIG. 12 is a schematic representation of the rear of an infant sleep bag according to an example.

FIG. 12 is a schematic representation of the rear of an infant sleep bag according to an example. In the example of FIG. 12, the bottom 1001 of the upper structure comprising the arm portions 121, 123 is in line with the seam position 107, although this need not be the case as will be appreciated.

Figure 13:
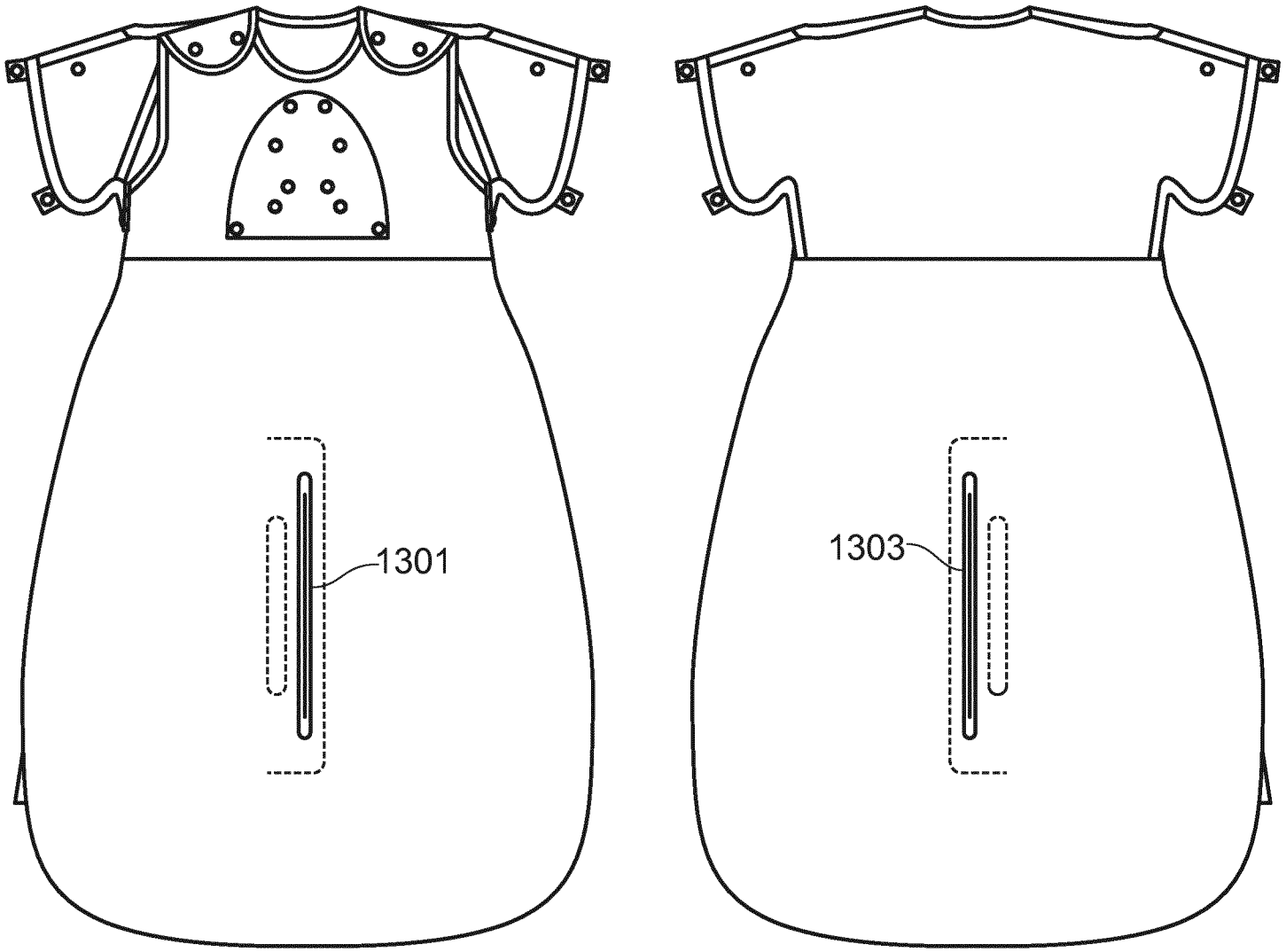
FIGS. 13*a-b* are schematic representations of an infant sleep bag according to an example.

FIGS. 13*a-b* are schematic representations of an infant sleep bag according to an example. In the example shown in FIGS. 13*a-b* (which show front and rear views of the same bag), openings 1301, 1303 can be provided to enable the bag to be used with a harness, such as a five point harness for example, for travelling. Typically, with swaddling-type products, the arms are inside the product and so a five point harness would be sitting over the top of the child's arms/hands, meaning that the straps are not sitting alongside their torso, (which would typically be against user instructions). Accordingly, if they were involved in a car crash for example, their hands and arms would crush against their bodies leading to actual bodily harm and it would also affect the functionality of the car seat to the extent that a child may even come out of their car seat.

In an example, if a parent wanted to swaddle their child whilst in a car seat or pushchair, they would simply put their child into a travelling device with their arms in an open/transitional position and a five point harness would then be closed around the child so that the arms would be positioned over the shoulder straps into the required swaddling position.

The travel opening 1301, 1303 can be made with a large bound buttonhole opening that a buckle can be inserted through when required. The opening may be closed when not in use by hook and loop type fastening which is attached female side to a flap, male side to the products skirt so that the rough male Velcro will not rub against the child.

Figure 14:
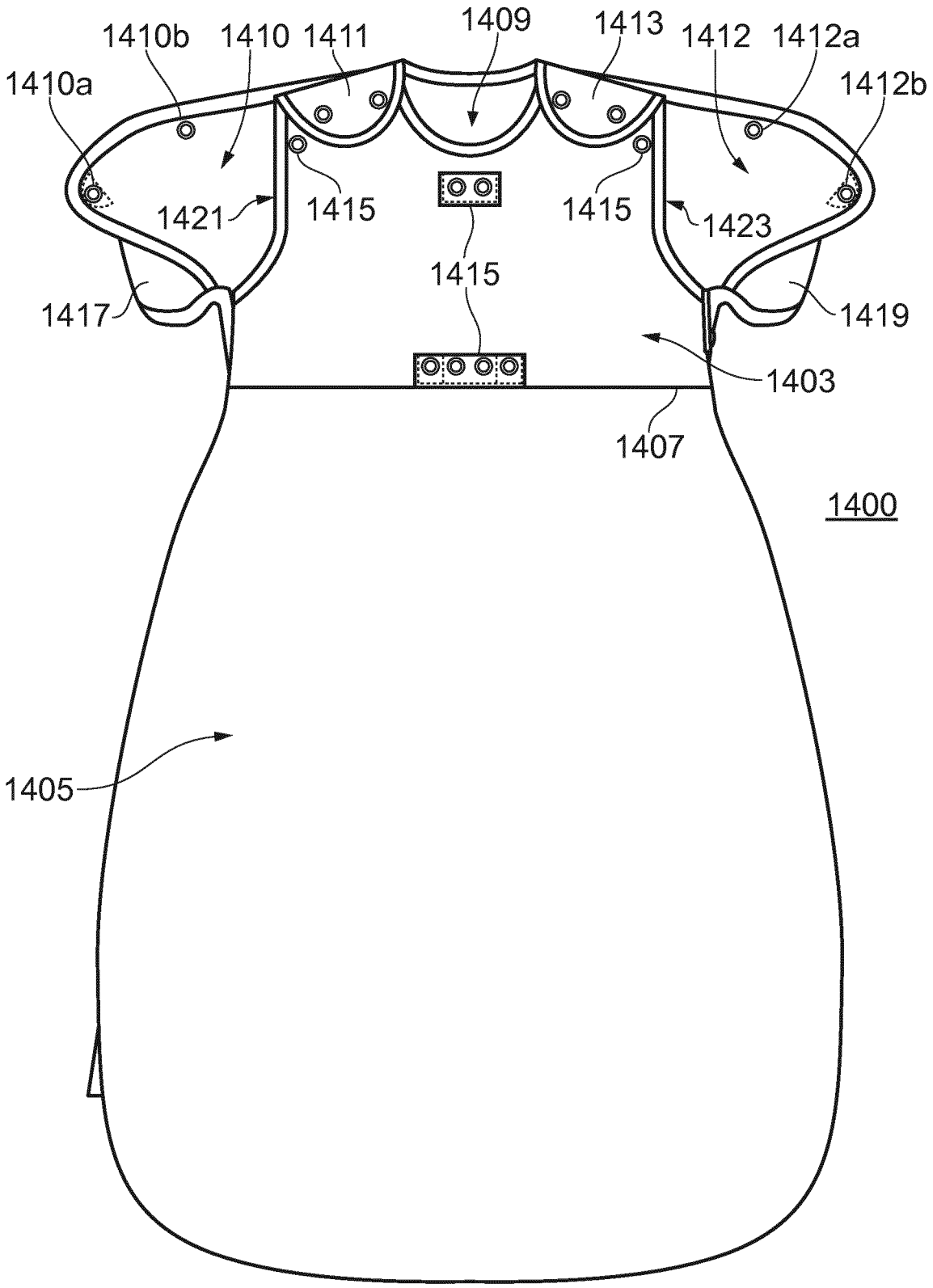
FIG. 14 is a schematic representation of an infant sleep bag according to an example.

FIG. 14 is a schematic representation of an infant sleep bag according to an example. More particularly, FIG. 14 depicts an alternative infant sleep bag. Similarly to the bag shown in FIGS. 1-13, the bag 1400 of FIG. 14 comprises an upper region, depicted generally as 1403 and a lower region, depicted generally as 1405. The upper and lower regions are separated from another, in an example, by a seam 1407, although, as in the case with the example of FIGS. 1-13, the bag may be a unitary item. The material used for the upper and lower regions may be the same or different. The thermal rating of the upper and lower regions may be the same or different. For example, the lower region may have a higher thermal rating (e.g. tog value) than the upper region, which itself may be made from a material with an elastic component to promote a swaddling function. Materials with an antibacterial, antimicrobial or insecticidal function or property may be used in either or both regions.

Lower region 1405 can be flared. That is, the lower region can widen away from the upper region in order to provide room for unhindered leg movement, which can be beneficial to reduce the risk of hip dysplasia in infants for example. A closure mechanism (not shown) can be provided around at least a portion of the lower region to enable the lower region to be opened to allow a nappy, for instance, to be changed without having to completely remove an infant from the bag 1400. On either side of a neck opening 1409, flap portions 1411, 1413 can be provided, which may be independently opened or closed using, for example, poppers, whereby to enable the bag 1400 to be fully opened so that an infant may be introduced or removed therefrom.

In the example shown in FIG. 14, the arms of an infant in the bag 1400 can be secured in various configurations using wing portions 1410, 1412. The wing portions 1410, 1412 can be arranged on either side of the upper region 1403 of the main body of the bag 1400 and are configured to enable an infant's arms to be secured in selected ones of multiple configurations using the wing portions themselves or the wing portions in combination with the main body of the bag 1400 as will be described in greater detail below.

Multiple fixing points 1410*a-b*, 1412*a-b* are provided on the wing portions. For the sake of clarity only two such fixing points are depicted in FIG. 14, although it will be appreciated that more or less can be provided. Multiple complementary fixing points 1415 can be provided on the body of the bag at various positions in order to enable the fixing points 1410*a-b*, 1412*a-b* to be releasably secured in different configurations. In the example of FIG. 14, the fixing points are in the form of popper portions (male or female) that can engage with corresponding (female or male) popper portions on the body of a bag. There can be a symmetry to the distribution of fixing points (about the vertical through the centre of the bag 1400), which enables the wing portions to be arranged or fixed in the same way, if desired, and the fixing points can be arranged centrally on the main body portion of the bag. Alternatively, wings may be arranged in different positions relative to one another simply by using a different set of fixings on either one or both of the wings and main body.

The bag 1400 has fewer fixing points than the bag shown in the example of FIGS. 1-13. It therefore has relatively fewer configurations available for selection by a user. Furthermore, it can be seen from FIG. 14 that wing portions 1410, 1412 are configured differently to those in the example of FIGS. 1-13 inasmuch as they comprise a flap with an overlapping portion 1417, 1419. An infant's arms pass through openings 1421, 1423, but will then be free to move unless the wing portions 1410, 1412 are fixed in some configuration using the fixing means. That is, in an example, the wing portions extend out from the back of the bag and are configured to be folded over portions of an infant's arms in order to constrain them in a desired position. This is in contrast to the example shown in FIG. 1-13, in which the arm portions comprise 'channels' through which an infant's arms pass.

Figure 15:
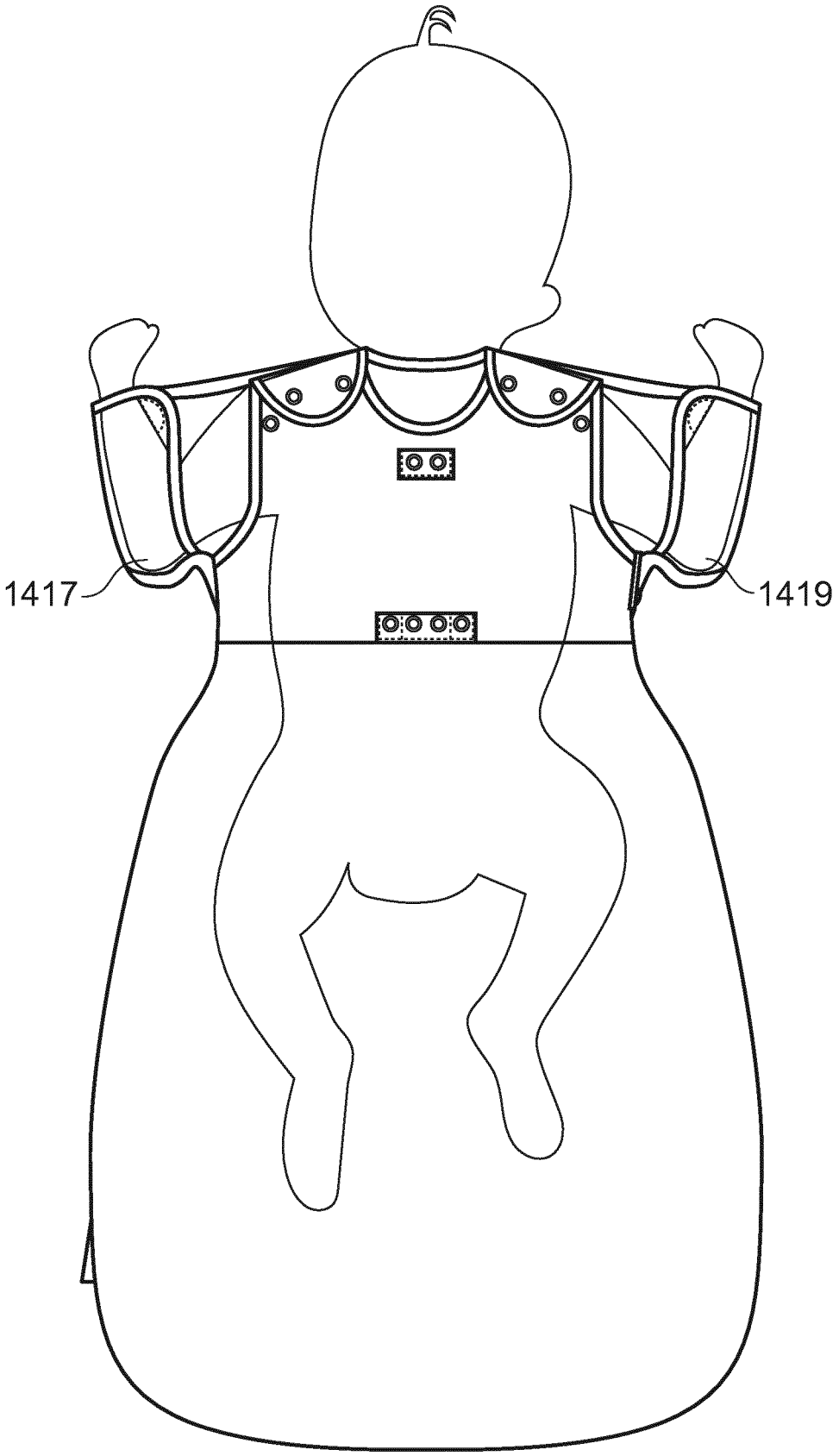
FIG. 15 is a schematic representation of the bag of FIG. 14 showing the position of an infant in a bag configuration in which the wing portions are provided in an 'arms-up' position.

FIG. 15 is a schematic representation of the bag of FIG. 14 showing the position of an infant in a bag configuration in which the wing portions are provided in an 'arms-up' position. As can be seen from FIG. 15, point 1410*a* is connected to point 1410*b* and 1412*b* is connected to 1412*a* with the infant's arms protruding from the opening at the top of the pouch defined by the wing portions fixed in this way. The elbows sit in the portions 1417, 1419. The infant's arms are therefore constrained to a degree, whilst still allowing some freedom of movement due to flexibility in the fabric of the bag and enabling non-nutritive sucking without any fabric in the way of the infant's hands.

Figure 16:
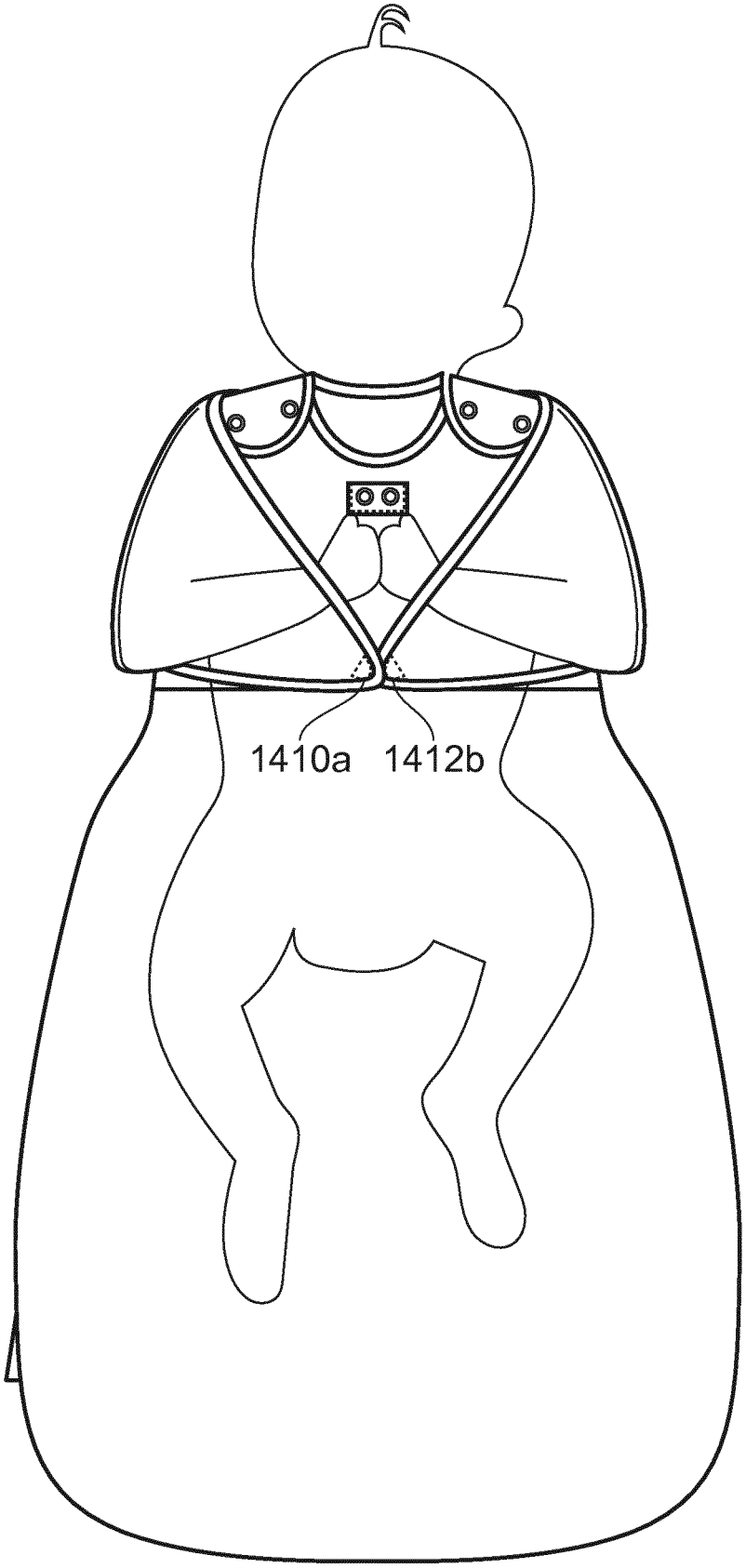
FIG. 16 is a schematic representation of the bag of FIG. 14 showing the position of an infant in a bag configuration in which the wing portions are provided in a 'hands to chest' position.

FIG. 16 is a schematic representation of the bag of FIG. 14 showing the position of an infant in a bag configuration in which the wing portions are provided in a 'hands to chest' position. As can be seen from FIG. 16 point 1410*a* is connected to one of the points 1415 as is point 1412*b*. The infant's arms are therefore constrained in the position shown, but with a degree of freedom of movement that can still enable the infant's hands to reach their mouth.

Figure 17:
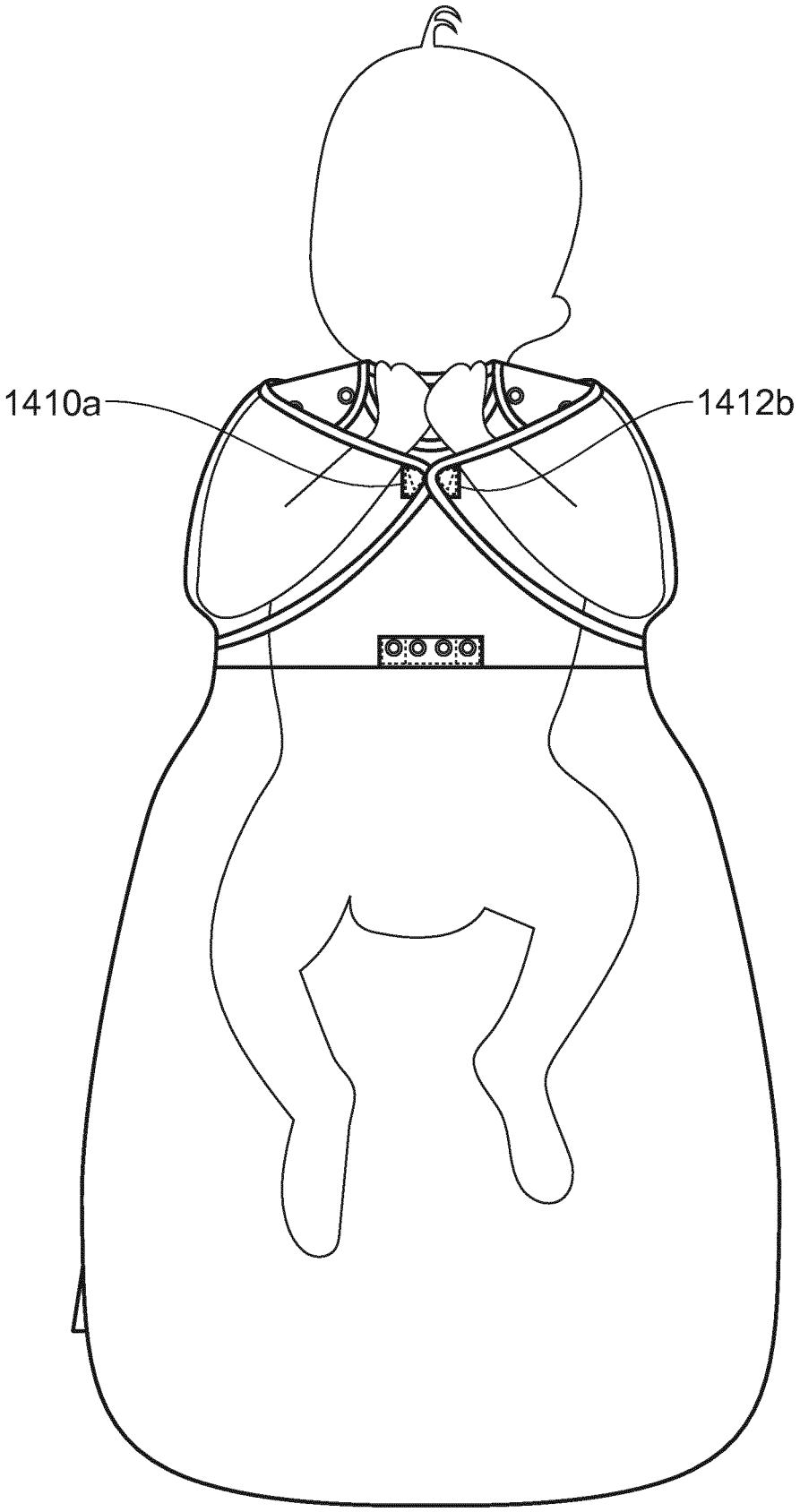
FIG. 17 is a schematic representation of the bag of FIG. 14 showing the position of an infant in a bag configuration in which the wing portions are provided in a 'hands to face/cheek' position.
Figure 18:
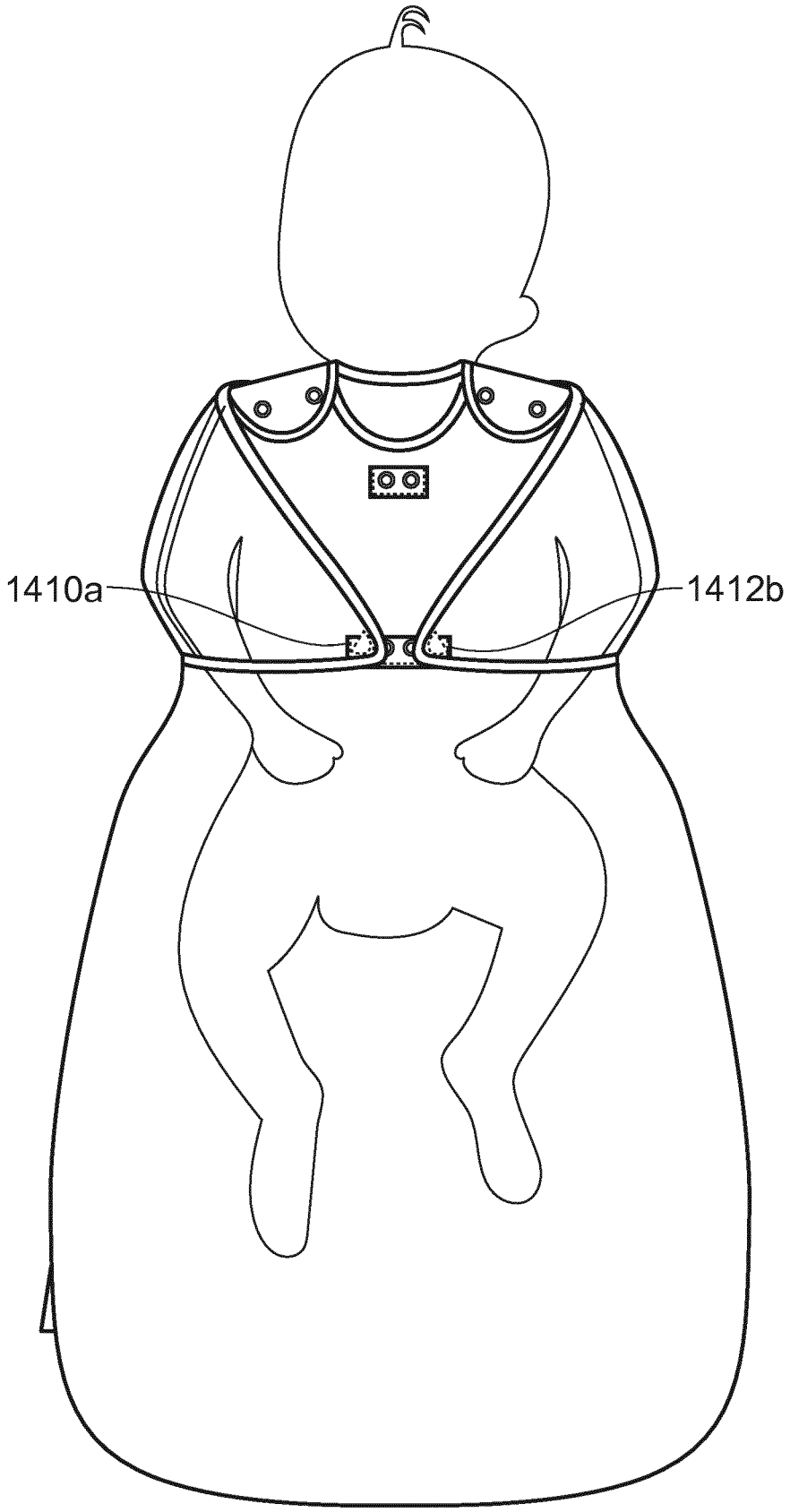
FIG. 18 is a schematic representation of the bag of FIG. 14 showing the position of an infant in a bag configuration in which the wing portions are provided in a 'hands down' position.

FIG. 17 is a schematic representation of the bag of FIG. 14 showing the position of an infant in a bag configuration in which the wing portions are provided in a 'hands to face/cheek' position, and FIG. 18 is a schematic representation of the bag of FIG. 14 showing the position of an infant in a bag configuration in which the wing portions are provided in a 'hands down' position within the bag.

Figure 19:
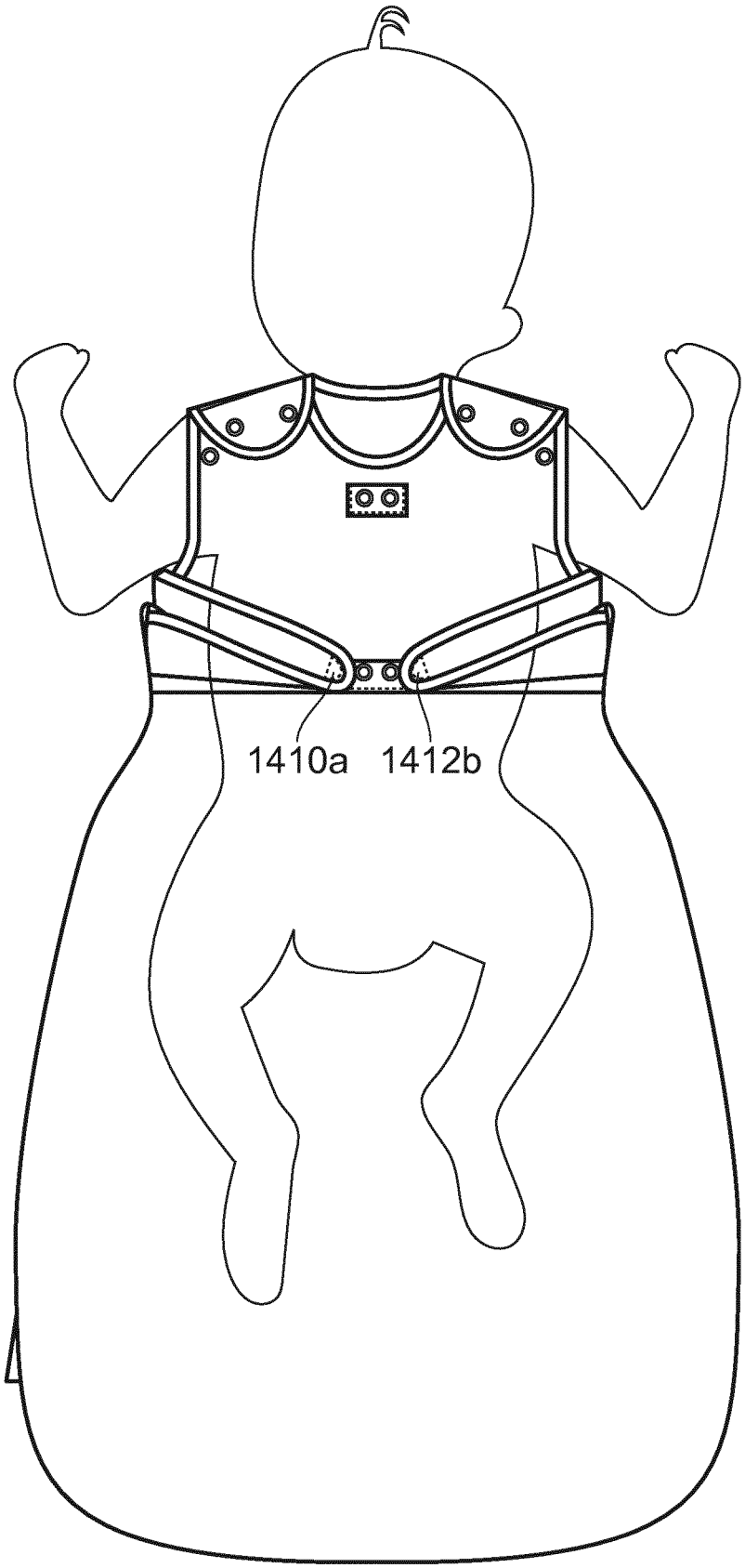
FIG. 19 is a schematic representation of the bag of FIG. 14 showing the position of an infant in a transitional bag configuration.

FIG. 19 is a schematic representation of the bag of FIG. 14 showing the position of an infant in a transitional bag configuration. In this configuration, as can be seen, the infant's arms are free to move and the wing portion are folded underneath the arms and connected to points 1415 as shown.

Figure 20:
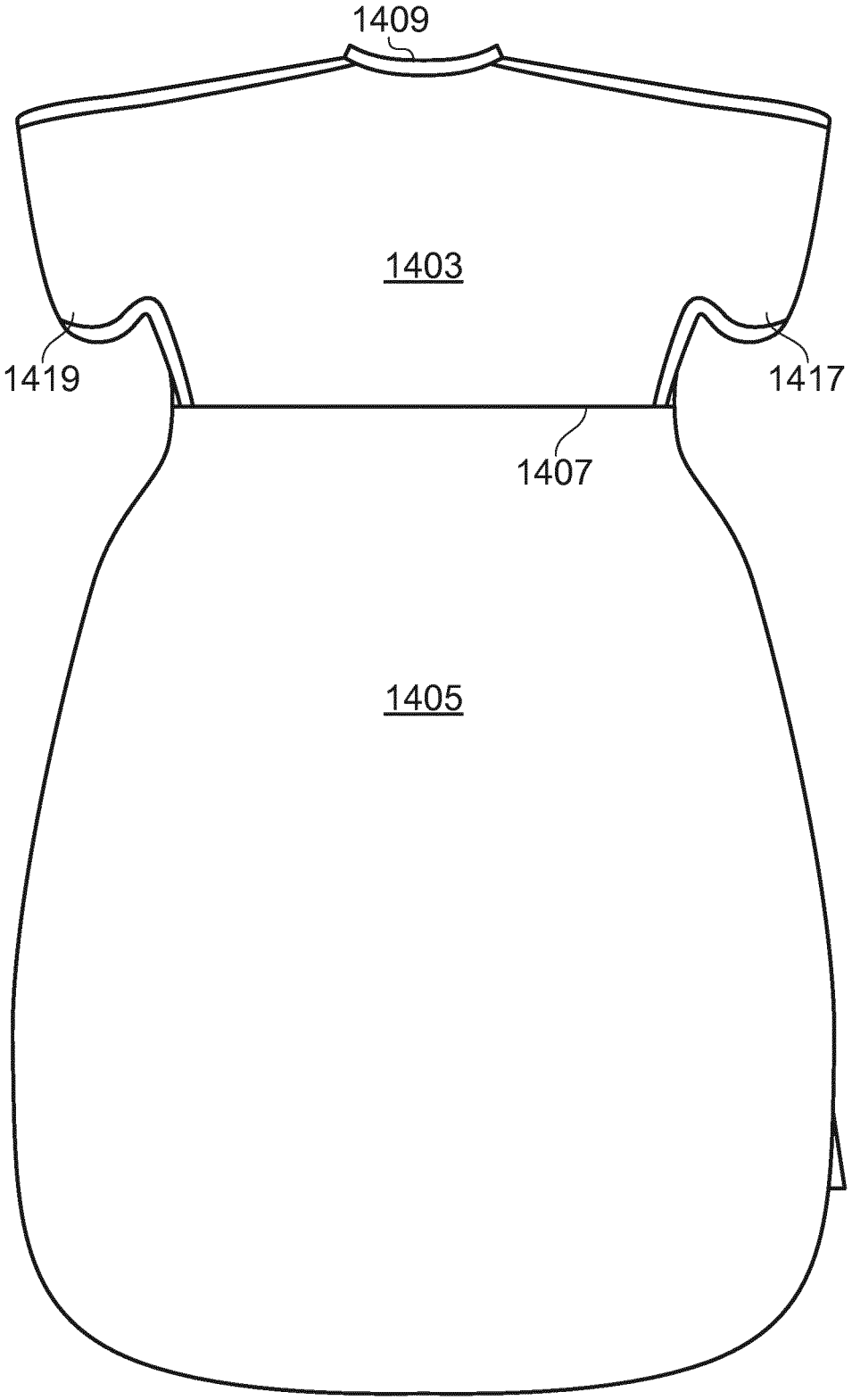
FIG. 20 is a schematic representation of the rear of the bag of FIG. 14.

FIG. 20 is a schematic representation of the rear of the bag of FIG. 14.

The present inventions can be embodied in other specific apparatus and/or methods. The described embodiments are to be considered in all respects as illustrative and not restrictive. In particular, the scope of the invention is indicated by the appended claims rather than by the description and figures herein. All changes that come within the meaning and range of equivalency of the claims are to be embraced within their scope.

The invention claimed is:

1. An infant sleep bag, comprising:

a main body having flap portions around a central neck opening wherein the flap portions, once secured, are located on opposite lateral sides of a central neck opening, and arm openings for receiving arms of an infant, the main body comprising multiple fasteners defining multiple body fixing points; and wing portions arranged on opposite ends of the main body, each wing portion including fasteners arranged to engage at least a portion of the multiple body fixing points to permit positioning of the wing portions into multiple swaddling configurations;

wherein each wing portion includes a wing arm opening to receive the arm of an infant;

wherein the wing portions, when engaged to the main body by the fasteners, is configured to wrap an infant's arms into a fixed swaddling position.

2. The infant sleep bag of claim 1 wherein the wing portions further define an opening for an infant hand when the wing portions are fixedly engaged to the main body.

3. The infant sleep bag of claim 1 wherein the multiple body fixing points are disposed about a center region on a front of the infant sleep bag.

4. The infant sleep bag of claim 1 further comprising a vent disposed between at least one arm opening and a flap portion.

5. The infant sleep bag of claim 1 wherein the multiple body fixing points includes snap fasteners.

6. The infant sleep bag of claim 1 wherein the multiple body fixing points includes hook and loop fastening.

7. The infant sleep bag of claim 1 wherein the multiple body fixing points are arranged around a periphery of at least one of the wing portions.

8. The infant sleep bag of claim 1 wherein the multiple body fixing points are spaced in a matrix configuration to permit different swaddling configurations.

* * * * *